United States Patent [19]

Siskin et al.

[11] Patent Number: 4,587,005

[45] **Date of Patent: * May 6, 1986**

[54] PROCESS FOR BENEFICIATING RUNDLE OIL-SHALE

[75] Inventors: Michael Siskin, Livingston; Glen Brons, Phillipsburg, both of N.J.

[73] Assignee: Exxon Research and Engineering Co., Florham Park, N.J.

[ * ] Notice: The portion of the term of this patent subsequent to Jan. 1, 2002 has been disclaimed.

[21] Appl. No.: 686,728

[22] Filed: Dec. 27, 1984

Related U.S. Application Data

[63] Continuation-in-part of Ser. No. 600,431, Apr. 16, 1984, Pat. No. 4,491,513.

[51] Int. Cl.[4] ..... C10G 1/04

[52] U.S. Cl. ..... 208/415; 423/114; 423/119; 423/131; 423/658.5; 208/429; 208/435

[58] Field of Search ..... 208/11 LE, 8 LE; 423/114, 115, 131, 130, 157, 658.5

[56] References Cited

U.S. PATENT DOCUMENTS 4,491,513 1/1985 Siskin et al. ..... 208/11 LE
4,491,514 1/1985 Siskin et al. ..... 208/11 LE

*Primary Examiner*—Andrew H. Metz
*Assistant Examiner*—A. Pal
*Attorney, Agent, or Firm*—Henry E. Naylor

[57] ABSTRACT

Disclosed is a process for removing mineral matter from Rundle oil-shale by contacting the oil-shale with (a) an ammonium salt solution and (b) an organic solvent, at a temperature from about 0° C. to about 300° C. for a time which is sufficient to substantially separate at least about 80 wt. % of the carbonate mineral matter from the oil-shale.

12 Claims, No Drawings

PROCESS FOR BENEFICIATING RUNDLE OIL-SHALE

CROSS REFERENCE TO RELATED APPLICATIONS

This application is a continuation-in-part application of copending U.S. Ser. No. 600,431, filed Apr. 16, 1984, now patented as U.S. Pat. No. 4,491,513.

BACKGROUND OF THE INVENTION

The present invention relates to the beneficiation of Rundle oil-shale by treating the oil-shale with an aqueous ammonium salt solution and shale oil at a temperature from about 0° C. to about 300° C. for a time sufficient to remove minerals from the oil-shale.

Oil-shale, a sedimentary rock found in vast formations in several parts of the world, contains about 5 to about 60 wt. % organic material. About 10% of this organic material is extractable with organic solvents and is called bitumen. The remainder of the organic material is insoluble in organic and inorganic solvents and is a crosslinked macromolecular material called kerogen. Much work has recently been done to develop efficient methods for acquiring useful liquids and gases from oil-shale as replacements for petroleum liquids. The inherent mineral matter in oil-shale represents significant debits in both handling and processing. Typically, the organic material which can be converted to useful fuels and chemical feedstock, preferably liquids, represents only about 10–25 wt. % of the oil-shale. Furthermore, during processing there is considerable abrasive wear on preparation and conversion plants owing to the nature of mineral matter contained in oil-shale. Also, relatively large reactor sizes are required to accommodate the higher material throughputs necessitated by the large quantities of mineral matter. Most important, large quantities of rock needs to be heated to high temperatures in order to breakdown the kerogen of the oil-shale to liquid and gaseous products that represent a loss in energy efficiency since much of this heat is not recoverable as useful work. Also, processes which include a catalyst are faced with a significant potential of the minerals inherently present in the oil-shale contributing to catalyst poisoning. Consequently, various processes have been devised over the years to beneficiate, or demineralize oil-shale prior to further processing to concentrate the organic material and alleviate the above mentioned problems associated with oil-shale processing.

Although both physical and chemical methods have been developed for separating organic material oil-shale, thereby leaving substantially all of the mineral matter behind, chemical methods usually are superior over physical methods because of better separation obtained. One conventional type of chemical method for the separation of kerogen from oil-shale is acid dissolution of the inorganics. Such a technique typically involves the digestion of oil-shale with hydrochloric acid, hydrofluoric acid, or both. The hydrochloric acid dissolves the carbonate minerals and the hydrofluoric acid dissolves the silicate and clay minerals, thereby leaving a kerogen material containing about 5 to 10 wt. % minerals matter. Although such schemes have met with varying degrees of success, they suffer the disadvantages of being corrossive and, in most cases, the inability to regenerate the acid reactants economically for recycle makes the process unattractive.

A variation in this acid technique is one disclosed by R. D. Thomas in *Fuel,* 48, 75–80 (1969) wherein all of the mineral carbonates are removed from Green River oil-shale by treatment with carbonic acid. Thomas discloses that after sodium hydroxide washing to remove fine clay-like particles, the carbonate-free material can be centrifuged in a saturated aqueous calcium chloride solution to yield a concentrate containing 85–95 wt. % of the original kerogen with an ash content of less than 30 wt. %. Attempts to reproduce the physical separation results after demineralization with carbonic acid have been unsuccessful. See Vandergrift, G. F., Winans, R. E., and Horwitz, E. P., *Fuel,* 59, 634–636 (1980).

A variation of using acids to enrich the kerogen content of oil-shales which are rich in carbonates involves leaching by use of a sulfuric acid medium generated by the oxidizing capabilities of specific bacteria which convert pyrite in the oil-shale to sulfuric acid. The sulfuric acid produced decomposes the carbonate minerals in the oil-shale leaving a kerogen enriched material containing significant amounts of silica. See U.S. Pat. No. 4,043,884.

Other approaches to chemical beneficiation include extraction of low grade Western U.S. oil-shales with aliphatic amides to recover 69 wt. % to 83 wt. % of the organics (U.S. Pat. No. 4,357,230), and treatment of various oil-shales with a 1:1 mixture of trichloroisocyanuric acid and a chlorine donor such as calcium hypochlorite in the presence of a petroleum based naphtha solvent giving recoveries of organics up to about 98 wt. % (U.K. Pat. No. 2,090,858).

Furthermore, disclosed in Intl. Patent Appl. Wo 82/03404 is a two-step treatment of oil-shale with 16 parts of fused alkali metal caustic at 350° C. for 40 minutes followed by a sulfuric acid wash which led to recovery of 86 wt. % of the organics. This type of treatment suffers from the disadvantage that it may have a detrimental effect on the kerogen structure and reactivity.

Although various methods have been used, including physical grinding combined with chemical treatment, for beneficiating oil-shale, such prior art methods have not been able to effect a significant separation of mineral matter from the organic material under relatively mild conditions without the reagent being simultaneously and irreversibly destroyed. Consequently, there is still a need in the art for processes which are able to beneficiate oil-shale under relatively mild conditions and leave the benefication reagent in a form which is easily regenerable. Furthermore, none of the prior art methods suggest the use of ammonium salts for beneficiating oil-shales.

SUMMARY OF THE INVENTION

In accordance with the present invention there is disclosed a process for removing mineral matter from Rundle oil-shale which process comprises contacting Rundle oil-shale with: (a) an ammonium salt solution and (b) a shale-oil, at a temperature from about 0° C. to about 300° C.

In preferred embodiments of the present invention, the Rundle oil-shale is contacted at a temperature from about 60° C. to about 250° C. and the ammonium salt is selected from the group consisting of ammonium carbonate, ammonium bicarbonate, ammonium acetate, ammonium chloride, ammonium nitrate, ammonium phosphates, and ammonium sulfate, and the shale oil is derived from Rundle oil-shale.

In other preferred embodiments of the present invention a nonionic surfactant is used.

In still other preferred embodiments of the present invention the instant process is conducted in two or three pH ranges wherein the pH ranges are selected from about 0.5 to 5, 5 to 9, and 9 to 12.

DETAILED DESCRIPTION OF THE INVENTION

The general composition and characteristics of oil-shales are well known (See "Kerogen" edited by B. Durand, Editor Technip, Paris 1980) and will, therefore, not be described in detail herein. For practical purposes, the oil-shale should contain at least about 5, preferably at least about 10, and more preferably at least about 20% by weight of organic material, based on the total weight of the oil-shale. Such oil-shales usually contain at least about 7.5, preferably at least about 15, and more preferably between about 25 and 75 gallons of oil per ton of oil-shale, by Fischer Assay.

Although the present invention can be practiced on any type of oil-shale, oil-shale from the Rundle deposits in Australia can only be beneficiated by the use of ammonium salts when in the presence of a shale-oil. That is, while an organic solvent, such as toluene, can be used with the ammonium salt in the beneficiation of Green-River oil-shale, Rundle oil-shale cannot be satisfactorily beneficiated when an organic solvent is substituted for the shale-oil. It is to be understood that the shale oil may be diluted with an organic solvent. Organic solvents which may be used as diluents herein are those which are substantially insoluble with water. Non-limiting examples of such solvents include toluene, heptane, BTX streams, cyclohexane and petroleum and coal derived fractions.

By BTX streams, we mean a stream comprised essentially of benzene, toluene, and xylene. Preferred is a boiling point shale-oil fraction, for example, a middle to high boiling point fraction, more preferably one which is a conversion product of the instant invention.

Although the particle size of the oil-shale is not critical, it is preferred for convenience of handling that the oil-shale be crushed to a particle size having an average diameter of less than about 1 inch, preferably less than about ½ inch. The diameter of the particles as referred to herein is the smallest size of the screen opening through which particles of the designated "diameter" will pass.

Ammonium salts suitable for use in the instant invention are ammonium salts of organic and inorganic acids. Preferred are the ammonium salts of strong mineral acids. Nonlimiting examples of such ammonium salts suitable for use herein include ammonium carbonate, ammonium bicarbonate, ammonium acetate, ammonium chloride, ammonium nitrate, ammonium sulfate, and ammonium phosphates. Preferred are ammonium nitrate and ammonium sulfate, more preferred is ammonium sulfate.

Preferred shale-oils are middle to high boiling point fractions, more preferred is one which is a conversion product of the instant invention.

In the practice of the present invention, the ratio (by volume) of shale-oil or shale-oil/organic solvent mixture to aqueous solution will range from about 0.4:1 to 2:1, preferably from about 0.4:1 to 0.6:1.

It is also within the scope of the present invention to use a surfactant, which can act as either a wetting agent to improve the aqueous phase-mineral contacting or as a sacrificial adsorbant thereby weakening the mineral-organic interactions. Anionic and cationic surfactants are not suitable herein because they are unable to achieve a physical separation of a the organic rich material from the mineral matter after the oil-shale is treated with the ammonium salt solution. The amount of surfactant which can be used herein will be in excess of about 0.1 wt. %, based on the weight of the ammonium salt solution.

Non-limiting examples of such nonionic surfactants include ethoxylated derivatives of phenols, amines, carboxylic acids, alcohols and mercaptans, as well as polyhydroxy compounds. The ethoxylated phenols may have the formula:

$$(R)r^{A}\text{—}[O(CH_2CH_2O)_p]_qH$$

wherein R is a $C_1$ to $C_{24}$ alkyl, A is benzene, naphthalene or diphenyl, p is 2 to 60, q is 1 or 2 and r is 1 to 5 with the proviso that when r is 1, R is at least $C_8$. Preferred nonionic surfactants are ethoxylated $C_8$–$C_{24}$ alkylphenols, ethoxylated octyl, nonyl or dodecyl phenols containing 8 to 24 —$CH_2CH_2O$—groups, or ethoxylated dimonyl phenols containing 8 to 50 —$CH_2CH_2O$— groups.

Ethoxylated amines may be cationic or nonionic depending on the degree of ethoxylation. Higher degrees of ethoxylation render fatty amines nonionic in character. Preferred amines are $C_8$ to $C_{30}$ alkyl amines, $C_8$ to $C_{30}$ ethoxylated amines or quaternary ammonium salts thereof. Ethoxylated amines of the formula:

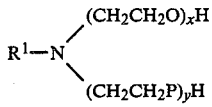

where $R^1$ is a $C_8$ to $C_{30}$ aliphatic radical and the sum of x+y is from 2 to 30.

Aliphatic carboxylic acids of from 8 to 30 carbon atoms can be esterified with ethylene oxide to form nonionic surfactants. The degree of ethoxylation may be from 2 to 30. Also, $C_8$ to $C_{25}$ alkanols and mercaptans can be converted to polethoxy ethers and thio-ethers by reaction with ethylene oxide.

Examples of nonionic surfactants which are not polyethoxylated are esters of sugar alcohols, sorbitol and mannitol. The acid moiety of the ester is generally a fatty acid. Other fatty acid derivatives include esters of di- and poly saccharides and condensates of fatty acids with alkanolamines.

The temperatures at which the instant process are carried out will generally be at temperatures from about 0° C. to about 100° C. when atmospheric pressure is employed. If higher pressures are employed the temperature can be as high as about 300° C. Preferred is a temperature from about 75° C. to about 250° C. If salts such as ammonium carbonate and ammonium bicarbonate are used, which decompose at temperatures greater than about 50° C., elevated pressures must be used to keep the components of the salts in solution. Also, proper steps must be taken to maintain low $CO_2$ partial pressures so as not to impede carbonate mineral decomposition.

In the practice of the present invention, the oil-shale is contacted with the ammonium salt solution for an effective amount of time in an appropriate reactor at a temperature from; that is, for a time sufficient to remove a desired amount of carbonate minerals from the oil-shale. It will be appreciated that the specific amount of time and temperature will be dependent on such things as temperature, the ammonium salt, the amount of ammonium salt, pressure, and particle size of the oil-shale employed. By way of example, a two molar aqueous solution of ammonium sulfate will remove at least about 90 wt. % of the carbonate mineral matter from 80–100 mesh particles of Rundle Ramsay Crossing oil-shale which contains about 18 wt. % organic material and about 8 wt. % carbonate minerals when the oil-shale is contacted with a 2M ammonium sulfate solution for 45 minutes at a temperature of 95° C. with 70 cc/min nitrogen sparging.

After the desired amount of mineral matter has been removed from the oil-shale the result is a two phase system if no organic phase is employed and three phase system if a shale oil phase is used. That is, there will be an upper shale-oil phase, a middle aqueous phase, and a lower solids phase. The upper phase will be rich in organic material from the oil-shale. The aqueous phase contains dissolved mineral matter and excess ammonium salt and the lower solids phase is primarily oil-shale mineral matter.

The ammonium salt solution should be present in at least a stoichiometric amount based on the amount of carbonate minerals present in the starting oil-shale. Generally, a 1 to 4 molar solution of the ammonium salt is adequate.

The process of the instant invention may be carried out in pH stages wherein each stage may consist of one or more cycles. The temperatures at which the stages are carried out will generally be at temperatures from about 0° C. to about 100° C., preferably about 60° C. to 100° C., when atmospheric pressure is employed. If higher pressures are employed the temperature can be as high as about 300° C.

In the practice of the present invention, when stages are employed, the oil-shale is contacted in a first stage with the aqueous ammonium salt solution for an effective amount of time in an appropriate reactor at an effective temperature and in a pH range of about 5 to 9. Effective amount of time means for a time sufficient to remove a desired amount of carbonate minerals from the oil-shale. It will be appreciated that the specific amount of time and temperature will be dependent on such things as temperature, specific ammonium salt, the amount of ammonium salt, pressure, and size of the oil-shale employed.

After the predetermined amount of mineral matter has been removed from the oil-shale, the result is a two phase system. That is, there will be an upper aqueous phase and a lower solids phase. Carbon dioxide and ammonia gas which evolve during the decomposition of minerals can be recovered and used in the regeneration of the ammonium salt. The resulting solid phase, which is higher in organic content than the starting oil-shale, is passed to a second stage and treated with a solution preferably containing ammonium ions, ammonia, or both, for an effective amount of time at an effective temperature in the presence of an organic solvent wherein the pH of the solution during this second stage is either from about 0.5 to 5 or about 9 to 12.

During treatment in the first stage carbonate minerals of the oil-shale are essentially decomposed, leaving quartz and clay as the predominant mineral matter. If it is desired to preferentially remove quartz then the second stage is conducted at a pH in the range of about 0.5 to 5. If it is desired to preferentially remove the clay minerals, then the second stage is conducted at a pH in the range of about 9 to 12. Of course a third stage may be used to remove the mineral matter left from the second stage. For example, the third stage will be conducted at a pH in the range of about 0.5 to 5 if quartz remains, and a range of about 9 to 12 if clay remains. More acidic conditions are needed for the preferential removal of quartz because the surface of the quartz crystallites are negatively charged, therefore, treating the essentially carbonate free product of the first stage with a more acidic solution neutralizes the negative charge and facilitates agglomeration and precipitation of the quartz. The term, preferential removal is used because some clays will precipitate in the lower pH range and some quartz will be removed in the higher pH range. Feldspars, which are neutral, and typically larger crystals are equally likely to be removed at high or low pH ranges.

In the second and optional third stages, it is desirable to have an insoluble organic layer present to allow the precipitated minerals to remain separated from the kerogen. It is to be understood herein that anyone or more of the stages can consist of one or more cycles.

While not wishing to be bound by any theory, we believe the staging of pH in the process of the present invention is advantageous because it permits increased selectivity to different reactions which in turn are more rapid over a given pH range and thereby increase the overall enrichment rate. For example, the decomposition of carbonate minerals is a stoichiometric reaction known to be more rapid under conditions of low pH. Therefore, to increase the carbonate decomposition rate, it is preferable to maintain the pH in the acid range (pH 5–6) instead of allowing the pH to drift to between 8 and 9. If this is done in a first stage, it produces a more porous rock and enables the small ammonia molecule and/or ammonium ion, in subsequent steps, to gain access to the clay-kerogen interaction sites and disrupt these either by displacement or by ion-exchange. This effect can be achieved by using several cycles of treatment with fresh ammonium sulfate solutions and/or by sparging an inert gas or gas mixture through the reaction mixture to remove the basic ammonia formed during the reaction. Furthermore, the rate of carbonate decomposition is more rapid in the absence of the insoluble organic layer, probably because contacting by the aqueous solution is better. Therefore, carrying out the first stage in the absence of the insoluble layer is also an option. By use of this approach, using four half-hour cycles with fresh ammonium sulfate solution, no insoluble organic layer and nitrogen sparging, over 90% of the carbonates can be removed from Green River oil shale in 2 hours at 90° C. instead of essentially the same amount in 72 hours at 85° C. in the presence of a shale-oil.

After a predetermined amount of mineral matter has been removed, the result is a three phase system. That is, there will be an upper solvent phase, a middle aqueous phase, and a lower solids phase. The upper solvent phase will contain organic rich material from the oil-shale, which organic material may be separated from the solvent by conventional distillation techniques or sent, either partially or in whole, directly to a conversion step. The middle aqueous phase contains dissolved mineral matter and excess ammonium ions/ammonia containing solution, and the lower solids phase is the mineral rich oil-shale fraction which has undergone at least two benefication stages.

Organic rich material which is not sent directly to conversion in the second stage is passed to a third stage wherein it is treated again with a solution preferably containing ammonium ions/ammonia, or both, in the presence of a shale-oil but this time in a pH range different than that of the second stage. That is, if the second stage was conducted in the pH range of 0.5 to 5 then the third stage is conducted in the pH range of 9 to 12, and vise versa.

The following examples serve to more fully describe the manner of practicing the above-described invention as well as to set forth the best modes contemplated for carrying out various aspects of the invention. It is to be understood that these examples in no way serve to limit the true scope of this invention, but rather, are presented for illustrative purposes.

EXAMPLE 1 COMPARATIVE

A 250 mL round bottom flask was charged with Rundle, Ramsay Crossing oil shale (5.01 g, −80 mesh) and a magnetic stir bar. Xylenes (50.0 mL) was next charged into the vessel. A cooling condenser with a nitrogen blanket supply was then attached.

While stirring, the mixture was heated to and maintained at 90° C. for 15 minutes. After which, 2M ammonium sulfate (50 mL) was charged into the vessel and stirring at 90° C. was continued for 21.5 hours.

The heat was then removed and the stirring stopped. It was observed that the organic, float, layer was clear but contained some tan-colored solids. The bulk of the original sample appeared to exist as a sink fraction in the aqueous phase.

By freezing the lower layer in dry ice/acetone, the float fraction was decanted. After allowing the sink fraction to return to room temperature, both the organic and aqueous layers were filtered through Teflon-lined, Buchner funnels. The remaining solids in each were washed with water (6×500 mL) and methanol (3×300 mL). After 2 hours of nitrogen blanketing/vacuum drying, each product was weighed: float fraction=0.32 g, sink fraction=3.85 g. Both products were tan in color.

Elemental analysis of the two fractions showed that 96.2 wt. % of the total organics were recovered in both fractions, but 87.1 wt. % of the organics were in the sink fraction. This sink fraction contained 15.9 wt. % organic carbon which represents little change from 15.1 wt. % organic carbon in the starting shale.

EXAMPLE 2

A 250 mL round bottom flask was charged with Rundle, Ramsay Crossing oil shale (5.01 g, −80 mesh), and a magnetic stir bar. Xylenes (50 mL containing 10.6 wt. % Rundle shale oil, was next charged into the vessel. A cooling condenser with a nitrogen blanket supply was then attached.

While stirring, the mixture was heated to and maintained at 90° C. for 15 minutes. After which, 2M ammonium sulfate (50 mL) was charged into the vessel and stirring at 90° C. was continued for 21.5 hours.

After the 21.5 hours, the heat was removed and the stirring stopped. It was observed that the sink fraction contained a significant amount of light gray-light tan solids. The float fraction was black, as was the starting solution, and also contained solids.

By freezing the lower layer in dry ice/acetone, the float fraction was decanted. After allowing the sink fraction to return to room temperature, both the organic and aqueous layers were filtered through Teflon-lined, Buchner funnels. The remaining solids in each were washed with xylenes (3×300 mL), water (6×500 mL) and methanol (3×300 mL). After 2 hours of nitrogen blanketing/vacuum drying, each product was weighed: float fraction (dark brown)=2.21 g, sink fraction (light tan-light gray)=2.05 g.

Elemental analysis of the two fractions showed that the float fraction contained 90.0 wt. % of the total organics. The wt. % organic carbon was increased from 14.1, in the starting shale, to 21.0 in the float fraction.

EXAMPLE 3

A 250 mL round bottom flask was charged with Rundle, Ramsay Crossing oil shale (4.99 g., −80 mesh), and a magnetic stir bar. Xylenes (50 mL) containing 10.6 wt. % Green River shale oil, was next charged into the vessel. A cooling condenser with a nitrogen blanket supply was then attached.

While stirring, the mixture was heated to and maintained at 90° C. for 15 minutes. After which, 2M ammonium sulfate (50 mL) was charged into the vessel and stirring at 90° C. was contained for 21.5 hours.

The heat was then removed and the stirring stopped. It was observed that the sink fraction contained a significant amount of light gray-light tan solids. The float fraction was black, as was the starting solution, and also contained solids.

By freezing the lower layer in dry ice/acetone, the float fraction was easily decanted off. After allowing the sink fraction to return to room temperature, both the organic and the aqueous layers were filtered through Teflon-lined, Buchner funnels. The remaining solids in each were washed with xylenes (3×300 mL), water (6×500 mL) and methanol (3×300 mL). After 2 hours of nitrogen blanketing/vacuum drying, each product was weighed: float fraction (dark brown)=3.02 g, sink fraction (light tan-light gray)=1.32 g.

Elemental analysis of the two fractions showed that the float fraction contained 95.7 wt. % of the total organics. The wt. % organic carbon was increased from 14.1, in the starting shale, to 22.3 in the float fraction.

EXAMPLE 4

Two Stage Procedure for the Enrichment of Rundle, Ramsay Crossing Oil Shale Using Aqueous Ammonium Sulfate and Rundle Shale Oil/Xylenes Stage 1:

The procedure used for Example 1 was repeated on 5.08 g of Rundle, Ramsay Crossing oil shale, only the reaction time was increased from 21.5 to 70.0 hours. Using the same work up procedure resulted in the following recoveries: float fraction (dark brown)=3.65 g, sink fraction (light gray)=0.73 g.

Elemental analysis of the two fractions showed that the float fraction contained greater than 98 wt. % of the original organics. This is an increase in wt. % organics from 17.8 to 26.4. The sink fraction was found to contain greater than 97 wt. % ash.

Stage 2:

The float fraction from Stage 1, containing 26.4 wt. % organics, was separated into halves. Each half was treated as in Stage 1 only no ammonium sulfate was used. One half was treated with dilute ammonium hydroxide (pH 11) while the other was treated with dilute sulfuric acid (pH 2.5). Both treatments were in the presence of the same Rundle shale oil/xylenes solution and their reaction times were only one hour each. The same work up procedure was used for both reactions.

The float fraction from the low pH treatment contained greater than 98 wt. % of the original organics and the final wt. % organic content was 33.0. This is 1.9 fold enrichment.

The float fraction from the high pH treatment contained greater than 97 wt. % of the original organics and the final wt. % organic content was 28.4.

EXAMPLE 5

To a 250 mL round bottom flask with a side arm and a cooling condenser was added Rundle, Ramsey Crossing oil shale (20.07 g, 1.60 g $CO_3$ minerals, 80/100 mesh) and a magnetic stir bar. Ammonium sulfate (120 mL of 2.0 M solution, pH 5.3, excess) was next charged into the vessel. A pipette was inserted through the side arm so that the tip was below the surface of the aqueous solution through which nitrogen was bubbled in at a rate of 70 cc/min.

While stirring, the reaction mixture was heated to and maintained at 90° C. for 45 minutes. Because of the angle of the cooling condenser (70°), the condensate was easily removed and collected as a clear liquid (~10 mL) of pH>11.

After the 45 minute reaction time, the heat was removed, the nitrogen tube taken out, and the stirring stopped. The entire mixture was poured into a 600 mL, Teflon filter paper-lined Buchner funnel and filtered. The pale yellow filtrate was collected (pH 6). The remaining solids were washed with water (8×500 mL) and methanol (4×500 mL). After two hours of nitrogen blanketing/vacuum drying, the product was weighed (18.64 g). TGA analysis of the product indicated that the weight loss corresponded directly with the carbonate reduction (90 wt. % of total carbonate minerals were removed).

What is claimed is:

1. A process for removing mineral matter from Rundle oil-shale which process comprises contacting the Rundle oil-shale with (a) an ammonium salt solution and (b) a shale-oil, at a temperature from about 0° C. to about 300° C. for a time which is sufficient to substantially separate at least about 80 wt. % of the carbonate mineral matter from the oil-shale.

2. The process of claim 1 wherein the temperature is from 0° C. to about 100° C. and atmospheric pressure is used.

3. The process of claim 1 wherein the ammonium salt solution contains one or more salts selected from the group consisting of ammonium carbonate, ammonium bicarbonate, ammonium acetate, ammonium chloride, ammonium nitrate, ammonium sulfate, and ammonium phosphates.

4. The process of claim 3 wherein the ammonium salt solution contains one or both of ammonium nitrate and ammonium sulfate.

5. The process of claim 4 wherein the shale-oil is a boiling point fraction of Rundle oil-shale.

6. The process of claim 1 wherein a nonionic surfactant is present.

7. The process of claim 5 wherein a nonionic surfactant is present.

8. The process of claim 6 wherein the nonionic surfactant is an ethoxylated derivative of a compound selected from the group consisting of phenols, amines, carboxylic acids, alcohols, mercaptans, and polyhydroxides.

9. The process of claim 8 wherein the surfactant is an ethoxylated phenol having the formula:

$$(R)_r A—[O(CH_2CH_2O)_p]_qH$$

wherein R is a $C_1$ to $C_{24}$ alkyl group, A is benzene, naphthalene or diphenyl, p is 2 to 60, q is 1 or 2, and r is 1 to 5 with the proviso that when r is 1, R is at least a $C_8$ alkyl group.

10. The process of claim 8 wherein the surfactant is an ethoxylated amine represented by the formula:

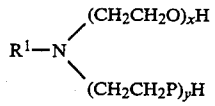

where $R^1$ is a $C_8$ to $C_{30}$ aliphatic radical and the sum of x+y is from 2 to 30.

11. The process of claim 1 wherein an organic solvent selected from the group consisting of toluene, heptane, BTX streams, cyclohexane, and petroleum and coal derived boiling point fractions is admixed with the shale-oil or a boiling point fraction of the shale-oil.

12. The process of claim 7 wherein an organic solvent selected from the group consisting of toluene, heptane, BTX streams, cyclohexane, and petroleum and coal derived boiling point fractions is admixed with the shale-oil or a boiling point fraction of the shale-oil.

* * * * *